United States Patent [19]

Gerlach

[11] 4,120,184

[45] Oct. 17, 1978

[54] LOCK WITH NORMALLY NON-REMOVABLE KEY AND AUXILIARY KEY REMOVAL DEVICE FOR USE IN INTERIOR LOCKSETS

[75] Inventor: John R. Gerlach, Monterey Park, Calif.

[73] Assignee: Emhart Industries, Inc., Farmington, Conn.

[21] Appl. No.: 834,650

[22] Filed: Sep. 19, 1977

[51] Int. Cl.[2] ..... E05B 11/00; E05B 19/00

[52] U.S. Cl. ..... 70/389; 70/395; 70/400

[58] Field of Search ..... 70/389, 395, 398, 400, 70/408, 409, 423–430

[56] References Cited

FOREIGN PATENT DOCUMENTS 2,442,681 3/1976 Fed. Rep. of Germany ..... 70/400

*Primary Examiner*—Robert L. Wolfe

*Attorney, Agent, or Firm*—Mahoney, Schick & Cislo

[57] ABSTRACT

A conventional keyed, pin-tumbler lock has an abutment portion formed on the key axially adjacent one of the key notches at the side thereof axially inward of the lock cylinder which normally axially obstructs that lock pin when the key is properly inserted in the lock cylinder key slot to prevent normal withdrawal of the key from the lock cylinder while still permitting free rotation of the lock cylinder by the key in its normal locking and unlocking movements. A key removal member is axially insertable into the key slot adjacent the key within a key axial recess and has a leading angled surface portion terminating axially in a raised surface portion which progressively move and ultimately retain that particular pin from its key pin notch and the key abutment portion obstruction, thereby permitting normal key removal from the lock cylinder. Alternatively, with the same key abutment portion and key removal member concept, the particular associated lock pin may be merely a lock cylinder pin and pin spring at all times contained solely within the lock cylinder but operating in the same general manner including always permitting lock cylinder rotation in key unlocking condition.

14 Claims, 7 Drawing Figures

LOCK WITH NORMALLY NON-REMOVABLE KEY AND AUXILIARY KEY REMOVAL DEVICE FOR USE IN INTERIOR LOCKSETS

BACKGROUND OF THE INVENTION

This invention relates to a keyed, pin-tumbler type of lock having a special abutment portion on the associated key which normally prevents removal of the key from the lock cylinder, but a separate key removal member may be inserted adjacent the key to eliminate the effectiveness of the key special abutment portion, thereby permitting normal key removal from the lock cylinder. With this arrangement, once the key is inserted in the lock cylinder, this lock is freely operable by the key to and between its locked and unlocked conditions while the key is always positively retained in the lock cylinder. But if it is desired to remove the key in either of the locked or unlocked conditions of the lock, the key removal member may be brought into use permitting such key removal. Such a lock construction is particularly useful in a door interior lockset where the conditions dictate that, although the door is normally retained locked, it must be capable of being quickly unlocked under emergency restrictions, yet there are occasions when it is desirable to retain the door securely locked against persons not having the proper key.

In recent years, it is well known that the incidence of crime has been rapidly rising and this includes the unauthorized entry by criminals into residences for the commission of burglary, as well as serious crimes against occupants. This, of course, has resulted in well founded fears by the occupants of residences, both relative to the loss of property and in most cases more important, the risk of physical injury. The result is that most residences in these times have properly installed locks for retaining the exterior doors of the residence at all times locked, whether any of the occupants are then therein or all are absent.

Where the particular exterior door of the residence is a solid door without glass openings and the surrounding residence walls within an appropriate distance from the door are likewise solid without glass openings, convenient door security may be most easily provided. A lockset of the usual keyed lock form may be provided at the exterior of the door and a lockset of usual thumb lever operation form, not requiring a key, may be used at the interior of the door. The exterior lockset may be locked or unlocked with the key as desired, and the interior lockset may be locked or unlocked merely by hand actuation of the thumb lever, so that the interior lockset, particularly, may always be quickly unlocked by hand and without a key at any time while, at the same time, this non-key operated interior lockset is never accessible to an attempted intruder without actual solid door or wall penetration. Equally important, in the event of an emergency occurring within the residence when occupants are therein, most usually such emergency being a fire, the residence exterior doors may be quickly opened from within without a key merely by actuation of the thumb lever actuators of the interior locksets.

A completely different situation is presented, however, when the architecture of the residence is such that the particular exterior door has glass openings therein or the walls closely adjacent the particular exterior door have such glass openings therein. Since an intruder can quickly break the glass of the door or wall, nonkeyed, thumb lever actuated locksets are not practical even for interior lockset use since it is easy for the intruder to break the glass, reach in and quickly unlock the door by use of the interior thumb lever actuated lockset. Although in this situation, when the occupants are within the residence, breaking glass usually will be heard and the proper police authorities or other assistance against the intruder can be quickly sought. This, however, is not true when the occupants are completely absent, in which case, the intruder is then free to burglarize the residence.

In the case where exterior doors are involved with the described glass openings, therefore, both keyed exterior and keyed interior locksets are strongly recommended if an effective frustration of the intruder is to be accomplished. Although this arrangement is perfectly satisfactory when all occupants are absent from the residence since, if the intruder breaks the glass and gains physical access to the interior lockset, he still cannot open the door without the key for the interior lockset, it still presents certain dangers during times when occupants are within the residence. Assume, for instance, that occupants are within the residence, the door interior lockset is of the key lock type and has been properly locked with the key removed, and still further assume that an emergency, such as a fire, occurs requiring quick exit from the residence by the occupants through the locked door, it can be seen that an obvious "panic" situation can be presented. To exit, the occupants must first quickly locate the key for the interior lockset, and then unlock the same, before the door can be opened and it is well known that such a "panic" situation may result in a failure to open the door and the very possible trapping of the occupants within the residence.

To avoid the possibility of such a "panic" situation arising where keyed, interior locksets are necessary, the answer is obvious, that is, when occupants are within the residence and a door lock is required to be retained locked, keep the key positioned in the lock at all times so that the lock can be quickly unlocked and the door opened in the event of an emergency situation arising. This has been strongly recommended by fire authorities. Again, even though it is possible for an intended intruder to break the glass of a glass opening, reach inside the residence and unlock the interior lockset using the key positioned therein, the sound of breaking glass will be heard by the occupants and the necessary defensive actions taken.

However, keeping a normally removable key in an interior lockset while the occupants are present within the residence, particularly in an active residence, is not necessarily a simple matter. For instance, with occupants moving frequently past the locked exterior door, there is always the possibility that the key will be inadvertently accidentally displaced from the lockset and without the key, the same "panic" situation can occur. Probably much more likely is where certain of the occupants are young children which can wrongly diliberately remove the key from the lockset.

OBJECTS AND SUMMARY OF THE INVENTION

It is, therefore, an object of this invention to provide a keyed, pin-tumbler lock in combination with a uniquely formed key therefor wherein, once the uniquely formed key is properly inserted into the key slot of the lock cylinder, although the key is then perfectly operable for moving the lock cylinder to and between locked and unlocked conditions, the key is positively retained in the lock cylinder key slot unless and until a special, separate key removal member is purposely used in association with the key. Thus, the lock and key combination is particularly adapted for use in interior locksets of residence or other building structure exterior doors which are required to be normally kept locked when occupants are therein, must be capable of being quickly unlocked in emergency situations, and yet the key must be selectively removable from the lock on occasions when all occupants are absent and it is desired to provide security against intruders not having a proper key. With the key always retained in the lock against removal therefrom during the time that occupants are present, the "panic" situations under emergency conditions as hereinbefore described are avoided.

It is a further object of this invention to provide the combination of a keyed, pin-tumbler lock, a uniquely formed normally non-removable key and a separate specifically usable key removal member of the foregoing general type wherein, in a first embodiment form, the pin-tumbler lock may be of standard form with the uniquely formed key and the special key removal member being usable therewith to produce the desired normally non-removable key and permissible deliberate key removal results of the present invention. In a second embodiment of the present invention, all of the pin-tumbler lock, the key and the key removal member are of unique and special form, but producing the same overall results as the first embodiment. More specifically, in the first embodiment of the present invention, at least one of the standard operable pin sets of the lock is brought into use for producing desired results, but said pin set does not require alteration in either form or operation, only the key for the lock requiring such alteration for producing the desired results of the present invention. In the second embodiment of the present invention, a special pin is provided totally operable within the lock cylinder working in conjunction with a uniquely formed key and a special key removal member so as not to require the involvement of the standard lock pin sets for producing the desired results of the present invention.

It is still a further object of this invention to provide a key for standard keyed, pin-tumbler locks wherein, through a unique formation of the key, the key is positively retained in the key slot of the lock cylinder once properaly inserted therein in the usual manner, yet the key is perfectly usable in the usual manner for moving the lock cylinder to and between its locked and unlocked conditions, and the key is only removable from the lock cylinder by use of a separate special key removal member deliberately inserted into the lock cylinder key slot. More particularly, this uniquely formed key may be provided with generally standard pin notches therein of appropriate radial depth to position the standard pin sets for permitting rotation of the lock cylinder by the key in the usual manner, with the important addition of a specific abutment means axially inward of the lock cylinder adjacent at least one of the key pin notches, such abutment means forming an obstruction normally preventing that lock pin set from moving axially and radially from that pin notch upon attempted withdrawal of the key from the lock cylinder key slot so that that lock pin set, as long as the key abutment means remains effective, will always retain the key in the lock cylinder key slot. When it is desired to remove the key from the lock cylinder key slot, a special, separate key removal member is inserted axially into the lock cylinder key slot adjacent the key and this key removal member has appropriate surface means thereon for moving the involved lock pin set radially outwardly along the key abutment means during axial insertion, finally fully radially removing the involved pin set from the obstruction by the abutment means, thereby permitting the usual withdrawal of the key from the lock cylinder pin slot.

Other objects and advantages of the invention will be apparent from the following specification and the accompanying drawings which are for the purpose of illustration only.

DESCRIPTION OF THE BEST EMBODIMENTS CONTEMPLATED

Referring to FIGS. 1 through 6 of the drawings, a first preferred embodiment incorporating the principles of the present invention is shown and includes a generally conventional keyed, pin-tumbler lock generally indicated at 10 having a lock cylinder generally indicated at 12 rotatable in the usual manner within a lock casing generally indicated at 14. The lock 10, as well as all of the lock components to be hereinafter described, may be formed of usual materials by usual manufacturing procedures except as hereinafter specifically pointed out. Furthermore, the lock 10 may be incorporated in a conventional lockset (not shown) for, for instance, retaining building structure doors, such as residence doors, closed and locked, again as will be hereinafter specifically alluded to in pointing out a typical use of the lock 10.

Figure 1:
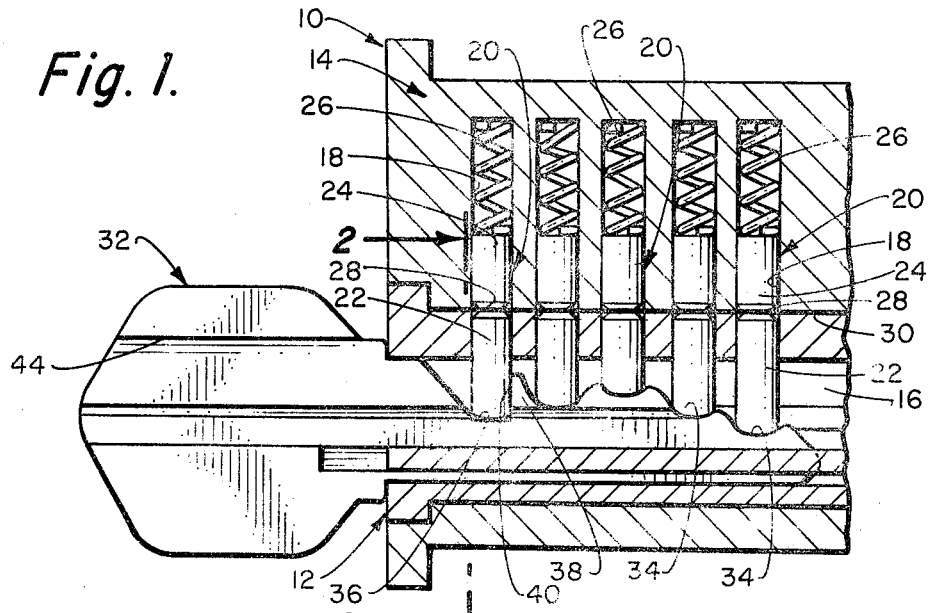
FIG. 1 is a fragmentary, vertical sectional view of a conventional keyed, pin-tumbler lock in combination with a uniquely formed key therefor incorporating a preferred embodiment of the principles of the present invention therein, this lock and key combination constituting a preferred first embodiment of the present invention.

More particularly, the lock 10 includes a usual axial key slot 16 in the rotatable lock cylinder 12 radially intersected by, in this case, five pin holes 18 which open radially inwardly into the key slot and extend continuously radially outwardly through the lock cylinder into the lock casing 14 when the lock is in either of its locked or unlocked conditions. Standard pin sets generally indicated at 20 are positioned, one in each of the pin holes 18, each pin set being comprised of a cylinder pin 22, a casing pin 24 and a compression spring 26. Thus, as thus far described, the conventional lock 10 is operable in the conventional manner, that is, when the pin sets 20 are positioned as shown in FIG. 1 with parting lines 28 thereof radially between the cylinder pins 22 and 24 aligned with a parting line 30 radially between the lock cylinder and casing 12 and 14, the lock cylinder may be rotated in the lock casing the full 360° between and to locked and unlocked conditions of the lock 10, but when the parting lines 28 of the pin sets 20 are positioned radially inwardly of the cylinder and casing parting line 30, only possible in the locked or unlocked condition, the casing pins 24 of the pin sets retain the lock cylinder against rotation in the lock casing.

Figure 2:
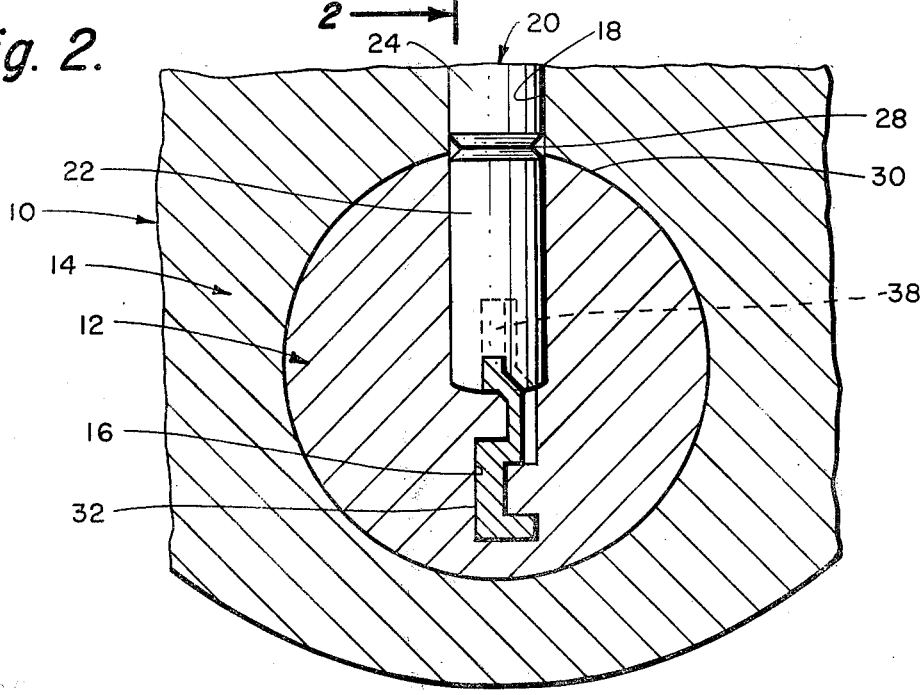
FIG. 2 is an enlarged, vertical sectional looking in the direction of the arrows 2—2 in FIG. 1.

Specifically to the novel principles of the present invention, a key generally indicated at 32 is provided for the lock 10, the key in many respects also being of conventional form compatible to the particular lock pin sets 20 and the key slot 16 of the lock cylinder 12, but having certain unique additions thereto supplying the novelty of the present invention. As shown in FIGS. 1 and 2, the key 32 is of usual grooved cross-sectional configuration in most respects compatible to the key slot 16 of the lock cylinder 12 for proper reception therein. Furthermore, the key 32 is formed with four conventional radial pin notches 34 and one unique radial pin notch 36. Although the term "pin notch" is used, it should be understood that this does not necessarily denote a depression or recess since any surface at the correct axial location and of correct radial dimensions will suffice for properly positioning a given pin set as is well known to those skilled in the art.

In any event, the conventional pin notches 34 and the unique pin notch 36 are all formed in radial depth proper for their respective pin set 20 so that when the key 32 is properly inserted in the key slot 16 of the lock cylinder 12, each of the pin sets will be properly positioned with its parting line 28 at the lock cylinder and casing parting line 30 in the conventional manner. Also, the four conventional pin notches 34 are formed with the surfaces axially adjacent thereof of proper arcuate configuration so that the related pin sets 20 will move radially as permitted by the related springs 26 to permit normal insertion and removal of the key 32 into and from the lock cylinder key slot 16. The unique pin notch 36, however, is formed with an abutment 38 axially inwardly adjacent thereof, that is, axially inwardly of the lock cylinder 12, which abutment projects radially outwardly of the key 32 or radially from the lowest or deepest part of the unique pin notch 36 as shown. It is preferred for optimum assurance of proper operability and ease of formation that the abutment 38 will have a substantially straight radial surface 40 axially facing the unique pin notch 36 which will thereby lie closely axially inwardly adjacent the cylinder pin 22 received radially therein when the key 32 is properly received in the lock cylinder key slot 16, the abutment radial surface extending radially along the facing cylinder pin radial surface.

Regardless of the exact preferred formation of the abutment 38 on the key 32, however, the more important factor is that it will function as an axial obstruction for the unique pin notch 36 and the cylinder pin 22 received therein preventing that cylinder pin from moving radially outwardly from the unique pin notch as it would conventionally if such abutment were not present. Thus, despite the location and formation of the abutment 38 on the key 32 inwardly axially adjacent the unique pin notch 36, the key may be axially inserted in usual manner and ultimately properly axially positioned within the lock cylinder 12 with the conventional unique and pin notches 34 and 36 properly positioning the pin sets 20 for permitting rotation of the lock cylinder 12 by the key within the lock casing 14 to and between its locked and unlocked conditions. At the same time, due to the abutment 38 axially obstructing the unique pin notch 36 and its cylinder pin 22 received therein, any attempted withdrawal of the key 32 from the lock cylinder key slot 16 will be frustrated even in the lock cylinder locked or unlocked conditions, since that cylinder pin will retain the key from axial outward movement. The result is that although the key 32 is easily properly insertable into the lock cylinder key slot 16 and is properly functional for operating the lock 10 when so positioned, once the key is properly inserted into the key slot, it is normally not removable therefrom.

Figure 3:
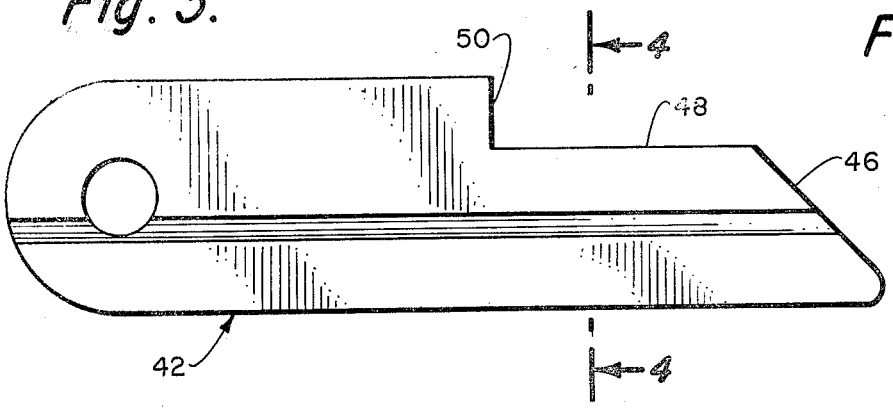
FIG. 3 is an enlarged, side elevational view of a preferred embodiment of a special key removal member adapted for use with the lock and key combination of FIGS. 1 and 2 according to the principles of the present invention.
Figure 4:
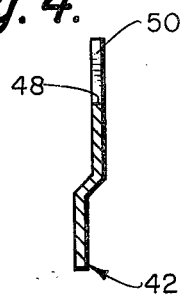
FIG. 4 is a vertical sectional view looking in the direction of the arrows 4—4 in FIG. 3.
Figure 5:
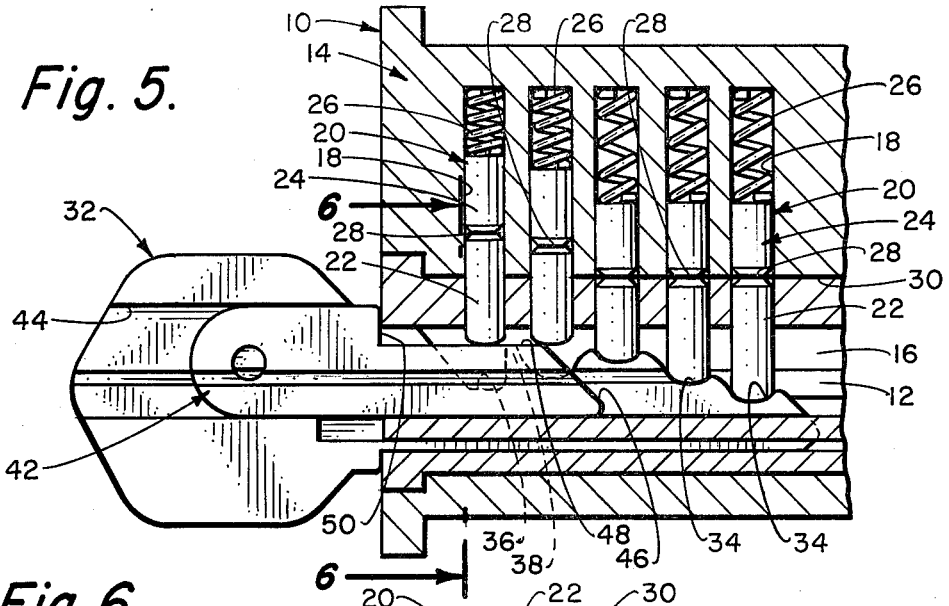
FIG. 5 is a view similar to FIG. 1, but with the key removal member of FIG. 3 positioned in the lock with the key.
Figure 6:
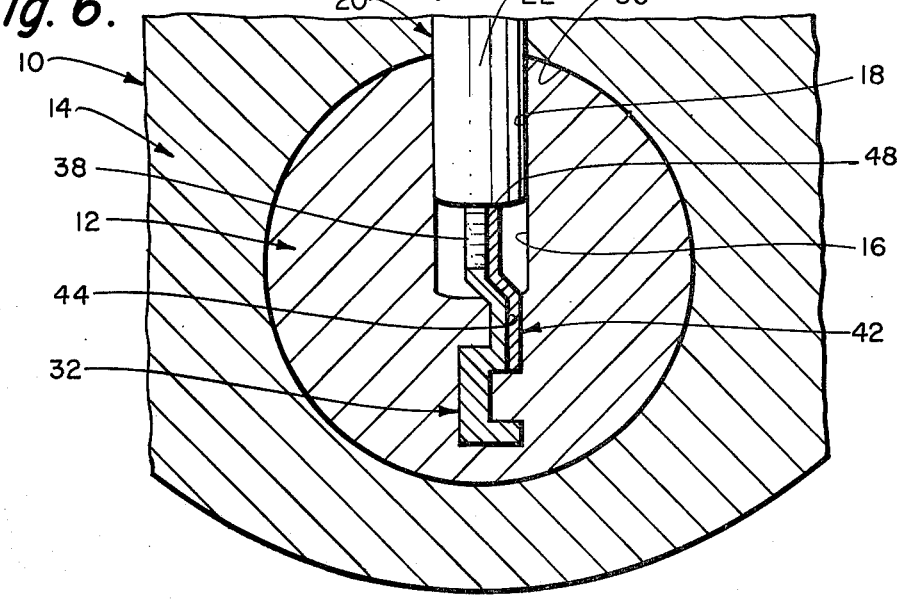
FIG. 6 is an enlarged, fragmentary, vertical sectional view looking in the direction of the arrows 6—6 in FIG. 5.

When it is desired to remove the key 32 from the lock cylinder key slot 16, however, such removal may be accomplished by use of a key removal member generally indicated at 42, shown separately in FIGS. 3 and 4, and in functional use in FIGS. 5 and 6. As can be best seen in FIGS. 1 and 2, although partially seen in FIGS. 5 and 6, the key 32 is provided with an axial recess 44 and the key removal member 42 is configured in size and cross section for reception in that recess so that even with the key properly positioned in the lock cylinder key slot 16 of the lock 10, the key removal member may be axially inserted adjacent the key within the key recess 44 also into the key slot. In addition, the key removal member 42 is formed with a leading angled surface portion 46 projecting rearwardly both axially and radially terminating rearwardly in a raised, preferably flat, surface portion 48, the latter terminating rearwardly in a stop surface portion 50. The exact positioning and functioning of these surface portions 46, 48 and 50 of the key removal member 42 can best be described by description of the use of the key removal member for removing the key 32 from the lock 10.

With the key 32 properly inserted in the lock cylinder key slot 16 of the lock 10 retained therein against removal by the abutment 38 as hereinbefore described (FIGS. 1 and 2) and it is desired to remove the key from the lock, therefore, the key removal member 42 is axially inserted into the key slot adjacent the key within the key recess 44. As the leading angled surface 46 of the key removal member 42 contacts the inner end of the abutment obstructed cylinder pin 22, it begins to raise that entire pin set 20 or begins to move the same radially outwardly and that cylinder pin ultimately radially inwardly abuts the raised surface portion 48 of the key removal member during continued insertion. The insertion of the key removal member 42 is completed by the stop surface portion 50 of the key removal member coming axially into contact against the outer end of the lock cylinder 12, thereby stopping further insertion, with that cylinder pin still retained raised by the raised surface portion 48. Although, in this final inserting motion of the key removal member 42, the next axially adjacent pin set 20 has also been contacted and at least partially raised by the leading angled surface portion 46, such is immaterial to the principles of the invention since that pin set has never been obstructed.

The final inserted positioning of the key removal member 42 is shown in FIGS. 5 and 6 and it will be noted that the raised surface portion 48 of the key removal member 42 is located so as to retain the previously obstructed cylinder pin 22 just radially clear of the key abutment 38. The important point is that this raised surface portion 48 of the key removal member 42 will be located so that it retains the previously obstructed cylinder pin 22 functionally free of obstruction by the key abutment 38 such that this previously obstructed cylinder pin cannot functionally prevent normal removal of the now assembled key 32 and key removal member 42. This, of course, will depend on the specific formations of the key abutment 38 and the particular cylinder pin inner end, for instance, with the particular cylinder pin inner end arcuately formed, the cylinder pin inner extremity could be slightly below the outer extremity of the key abutment since the arcuate surface would still permit that pin set to ride over the abutment when the assembled key and key removal member are withdrawn axially.

Thus, according to this first embodiment of the present invention, a unique key 32 with a separate special appropriate key removal member 42 are provided for use in combination with a conventional keyed, pin-tumbler lock 10 wherein, absent the key removal member 42, normal insertion of the unique key 32 into the key slot 16 of the lock cylinder 12 results in the key, merely through normal functioning of the lock, being retained in the lock cylinder against removal therefrom. The key 32 is still normally functional in the lock cylinder 12 so that the same may be used for moving the lock cylinder to and between its locked and unlocked conditions, the only difference from normal being that the key is positively obstructed by the key abutment 38 being interfered with by one of the normal lock pin sets 20 to prevent such key removal. However, when it is desired to remove the key 32 from the lock cylinder key slot 16, the special key removal member 42 may be brought into functional position inserted adjacent the key for withdrawing the lock pin set 20 interfering with the key abutment 38 and thereby permitting simultaneous withdrawal from the key slot 16 of both the key and the key removal member.

It is further pointed out that although in this first embodiment of the novel principles of the present invention illustrated in FIGS. 1 through 6, a particularly located key unique pin notch 36 with its abutment 38 is used with a particular one of the conventional lock pin sets 20 for providing the unique functioning described, the same functioning could be obtained still with use of the conventional lock pins by placing the key abutment 38 at any one or all of the key pin notches 34 and 36. Of course, the key removal member 42 would have to be altered to provide its described pin set displacement function relative to a differently located key abutment 38 or multiple key abutments if so provided. In all suggested altered constructions, the lock 10 could still be of standard form and the same overall functioning of the present invention would be substantially the same.

Figure 7:
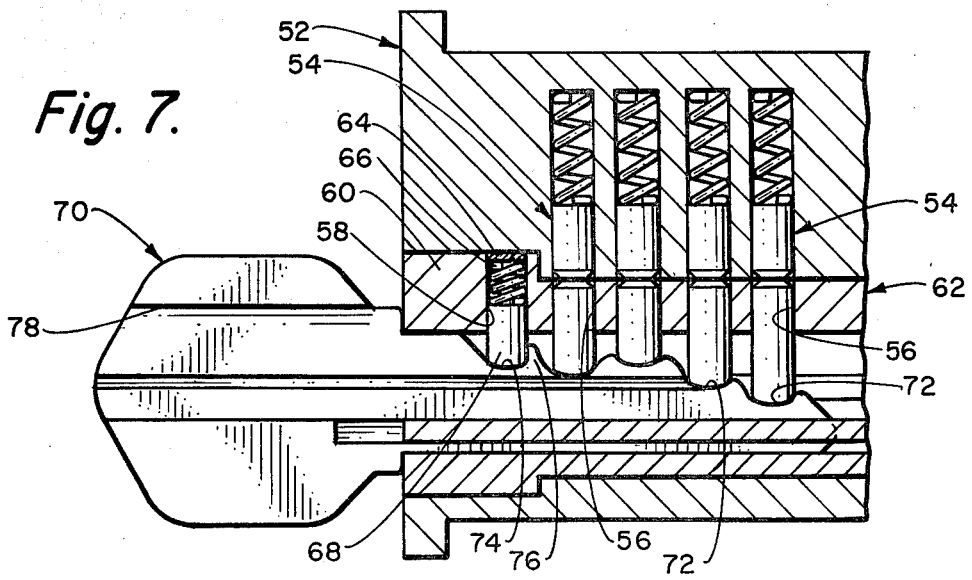
FIG. 7 is a fragmentary, vertical sectional view of a keyed, pin-tumbler lock and key combination incorporating a preferred second embodiment according to the principles of the present invention.

A second embodiment of the principles of the present invention is shown in FIG. 7 and the basic difference thereof from the first embodiment is a slight alteration of the lock from standard construction. As shown, a keyed, pin-tumbler lock generally indicated at 52 has only four standard pin sets 54 operating conventionally in appropriate pin holes 56. A special additional pin hole 58 is formed totally within a circumferentially enlarged portion 60 of an otherwise standard lock cylinder 62, the special pin hole having a radially outward plug 64 retaining a compression spring 66 and a special cylinder pin 68 therein. A key generally indicated at 70 is essentially functionally the same having conventional notches 72 for the standard pin sets 54, a unique pin notch 74 with abutment 76 for the special cylinder pin 68, and an axial recess 78 for reception and positioning of a similarly functional key removal member (not shown).

The operation of this second embodiment lock and key combination is substantially identical, that is, insertion of the key 70 into proper operable position within the lock cylinder 62 causes all of the standard pin sets 54 to be received in their conventional pin notches 72 and the special cylinder pin 68 to ride axially up over the abutment 76 and be received in the unique pin notch 74. The key abutment 76 thereby obstructs the key unique pin notch 74 and the lock special cylinder pin 68 so that the special cylinder pin, in turn, obstructs the key 70 from removal from the lock cylinder 62 even though the key is perfectly operable for selectively moving the lock cylinder 62 to and between its locked and unlocked conditions. When desired, the key removal member (not shown) formed similar to before and functional in the identical manner is brought into use adjacent the key 70 within the key recess 78 for raising or withdrawing the special cylinder pin 68 from further obstruction by the key abutment 76 so that the key and key removal member may be simultaneously withdrawn from the lock cylinder 62.

One very important use for either embodiment of the lock, key and key removal member combination of the present invention is for incorporation in an interior lockset of an exterior door or doors of a building structure, such as a residence, where either that door has glass openings therein or the closely adjacent surrounding wall has glass openings therein, in order to provide maximum security for the particular door, while still providing maximum safety for occupants when within the residence. For instance, using the first embodiment lock 10 and key 32 which is most advantageous since the lock may be a standard keyed, pin-tumbler lock and only the key 32 requires alteration, with the lock 10 in the interior lockset of the residence exterior door as described, once the key is inserted, it will be retained in the lock, although perfectly operable for moving the lock cylinder 12 to and between its locked and unlocked conditions. This means that with occupants within the residence and the lock 10 in locked condition, the key 32 will always be present, trapped in the lock, for use in moving the lock to its unlocked condition for quickly opening the door. Although an intended intruder can always break the glass of the door or wall glass opening and thereby obtain access to this interior lock 10, with occupants within the residence, the noise of breaking glass will be heard and the necessary assistance can be summoned by the occupants, but equally important, if an emergency occurs within the residence, such as a fire, "panic" circumstances will never be presented since the occupants will always have the key within the lock to unlock the same and open the door for exiting the residence.

At the same time, when all occupants intend to leave the residence, the door may be left locked without the key 32 by bringing into use the special key removal member 42. The key removal member 42 is merely inserted into the lock cylinder key slot 16 adjacent the key 32 within the key recess 44 and upon full insertion, the key and key removal member may be simultaneously withdrawn from the lock 10 in either of the locked or unlocked conditions of the lock. Thus, with the door retained locked by the lock 10 and with the key 32 now removed and not present, even though an intended intruder does break the glass and gain access to the lock 10 through one of the glass openings, he still cannot unlock the lock and open the door.

I claim:

1. In a keyed, pin-tumbler lock of the general type having a lock cylinder rotatable in a lock casing, a key slot in the cylinder, a series of spaced-apart radial pin holes partially in each of the lock casing and cylinder and intersecting the key slot, resiliently inwardly urged sets of casing and cylinder pins with one set in each pin hole, a key in the key slot axially intersecting each of the pin holes with a key notch therein aligned for each set of pins positioning that pin set with a parting line between its casing and cylinder pins at a casing-cylinder parting line permitting cylinder rotation by the key; the improvements in combination therewith comprising: a radial pin hole at least in said lock cylinder intersecting said key slot and spaced from any other radial pin hole; a cylinder pin in that said cylinder pin hole; resiliently reacting means for urging that said cylinder pin into said key slot; a key notch in said key radially aligned with and abutting an end of that said cylinder pin when said key is properly in said key slot; abutment means on said key at an axial side of at least that said key notch axially inward of said lock cylinder at all times axially obstructing that said cylinder pin when that said cylinder pin is in its said key notch and in all positions of said lock cylinder for preventing radial disengagement of that said cylinder pin radially from its said key notch upon attempted axial removal of said key from said key slot to thereby prevent such key removal from said key slot in all positions of said lock cylinder; said resiliently reacting means being constructed and arranged relative to that said cylinder pin to permit free rotation of said lock cylinder at all times at least when that said cylinder pin is received in its said key notch; all key notches in said key including that said key notch having usual surface means at axial sides thereof axially outward of said lock cylinder where necessary for at all times permitting free usual insertion of said key into said key slot in usual manner, all key notches in said key except those having said abutment means having usual surface means at axial sides thereof axially inward of said lock cylinder where necessary for at all times permitting free usual removal of said key from said key slot; a separate key removal member axially insertable into said key slot adjacent said key and having removal surface means thereon for permitting said insertion while moving and retaining at least that said cylinder pin radially from its said key notch and said abutment means obstruction to thereby permit usual axial removal of said key from said key slot.

2. In a keyed, pin-tumbler lock as defined in claim 1 in which that said radial pin hole is partially in each of said lock casing and cylinder; and in which said resiliently reacting means includes a casing pin in that said pin hole radially outward of that said cylinder pin and resilient means in that said pin hole radially outward of that said casing pin within said casing thereby forming one of said usual pin sets of casing and cylinder pins with a parting line therebetween, that said key notch in said key positioning that said pin set with said pin set parting line at said casing-cylinder parting line permitting cylinder rotation by said key when said key is properly in said key slot.

3. In a keyed, pin-tumbler lock as defined in claim 1 in which said abutment means on said key includes a radially outwardly extending key portion axially adjacent an end portion of that said cylinder pin.

4. In a keyed, pin-tumbler lock as defined in claim 1 in which said abutment means on said key includes a radially outwardly extending key portion axially adjacent an end portion of that said cylinder pin; in which that said radial pin hole is partially in each of said lock casing and cylinder; and in which said resiliently reacting means includes a casing pin in that said pin hole radially outward of that said cylinder pin and resilient means in that said pin hole radially outward of that said casing pin within said casing thereby forming one of said usual pin sets of casing and cylinder pins with a parting line therebetween, that said key notch in said key positioning that said pin set with said pin set parting line at said casing-cylinder parting line permitting cylinder rotation by said key when said key is properly in said key slot.

5. In a keyed, pin-tumbler lock as defined in claim 1 in which said removal surface means of said key removal member includes a leading angled surface portion terminating axially in a following raised surface portion, said removal surface means angled surface portion progressively moving that said cylinder pin radially from that said key notch and said abutment means obstruction during insertion of said key removal member into said key slot and said removal surface means raised surface portion retaining that said cylinder pin from that said key notch and said abutment means obstruction after said key removal member insertion.

6. In a keyed, pin-tumbler lock as defined in claim 1 in which said removal surface means of said key removal member includes a leading angled surface portion terminating axially in a following raised surface portion, said removal surface means angled surface portion progressively moving that said cylinder pin radially from that said key notch and said abutment means obstruction during insertion of said key removal member into said key slot and said removal surface means raised surface portion retaining that said cylinder pin from that said key notch and said abutment means obstruction after said key removal member insertion; in which that said radial pin hole is partially in each of said lock casing and cylinder; and in which said resiliently reacting means includes a casing pin in that said pin hole radially outward of that said cylinder pin and resilient means in that said pin hole radially outward of that said casing pin within said casing thereby forming one of said usual pin sets of casing and cylinder pins with a parting line therebetween, that said key notch in said key positioning that said pin set with said pin set parting line at said casing-cylinder parting line permitting cylinder rotation by said key when said key is properly in said key slot.

7. In a keyed, pin-tumbler lock as defined in claim 1 in which said abutment means on said key includes a radially outwardly extending key portion axially adjacent an end portion of that said cylinder pin; in which said removal surface means of said key removal member includes a leading angled surface portion terminating axially in a following raised surface portion, said removal surface means angled surface portion progressively moving that said cylinder pin radially from that said key notch and said abutment means obstruction during insertion of said key removal member into said key slot and said removal surface means raised surface portion retaining that said cylinder pin from that said key notch and said abutment means obstruction after said key removal member insertion; in which that said radial pin hole is partially in each of said lock casing and cylinder; and in which said resiliently reacting means includes a casing in that said pin hole radially outward of that said cylinder pin and resilient means in that said pin hole radially outward of that said casing pin within said casing thereby forming one of said usual pin sets of casing and cylinder pins with a parting line therebetween, that said key notch in said key positioning that said pin set with said pin set parting line at said casing-cylinder parting line permitting cylinder rotation by said key when said key is properly in said key slot.

8. In a key for a pin-type tumbler lock, the key being of the type having a series of spaced-apart pin notches therein positioning a series of lock pin sets permitting rotation of a lock cylinder when the key is properly inserted axially inwardly into a lock cylinder slot; the improvements comprising: an abutment axially inwardly adjacent at least one of said pin notches having obstructing surface means thereon at all times axially obstructing that lock pin upon that lock pin being received in said one pin notch for preventing radial disengagement of that lock pin from said one pin notch upon an attempted usual axial removal of said key from said lock cylinder key slot; all pin notches including said one pin notch having usual surface means at axial sides thereof axially outward of said lock cylinder where necessary for at all times permitting free usual insertion of said key into said key slot in usual manner, all pin notches except those having said obstructing surface means thereon having usual surface means at axial sides thereof axially inward of said lock cylinder where necessary for at all times permitting free usual removal of said key from said key slot; a separate key removal member positionable adjacent said key having removal surface means thereon for initially moving that lock pin radially along said key abutment during and while permitting axial inward insertion of said key removal member into said adjacent positioning relative to said key and then retaining that lock pin both radially and axially clear of said abutment, thereby permitting usual removal of said key from said lock cylinder key slot.

9. In a key for a pin-tumbler lock as defined in claim 8 in which said abutment obstructing surface means includes a radially outwardly extending surface positioned for being closely adjacent that lock pin at least spaced radially outwardly.

10. In a key for a pin-tumbler lock as defined in claim 8 in which said key removal member removal surface means includes an axially leading both radially outwardly and axially extending surface.

11. In a key for a pin-tumbler lock as defined in claim 8 in which said key removal member removal surface means includes an axially leading both radially outwardly and axially extending surface followed by a generally axially extending surface.

12. In a key for a pin-tumbler lock as defined in claim 8 in which said abutment obstructing surface means includes a radially outwardly extending surface positioned for being closely adjacent that lock pin at least spaced radially outwardly; and in which said key removal member removal surface means includes an axially leading both radially outwardly and axially extending surface.

13. In a keyed, pin-tumbler lock of the general type having a lock cylinder rotatable in a lock casing, a key slot in the cylinder, a series of radial pin holes partially in each of the lock casing and cylinder and intersecting the key slot, resiliently inwardly urged sets of casing and cylinder pins with one set in each pin hole, a key in the key slot axially intersecting each of the pin holes with a key notch therein for each set of pins positioning that pin set with a parting line between its casing and cylinder pins at a casing-cylinder parting line permitting cylinder rotation by the key; the improvements in combination therewith comprising: a radial pin hole at least in said lock cylinder intersecting said key slot; a cylinder pin in said cylinder pin hole; resiliently reacting means for urging said cylinder pin into said key slot, said resiliently reacting means including resilient means in said pin hole at all times solely within said lock cylinder for urging said cylinder pin into said key slot; a key notch in said key radially aligned with and abutting an end of said cylinder pin when said key is properly in said key slot; abutment means on said key at an axial side of said key notch axially inward of said lock cylinder at all times axially obstructing said cylinder pin when said cylinder pin is in said key notch and in all positions of said lock cylinder for preventing radial disengagement of said cylinder pin radially from said key notch upon attempted removal of said key from said key slot to thereby prevent such key removal from said key slot in all positions of said lock cylinder; said resilient means being constructed and arranged relative to said cylinder pin to permit free rotation of said lock cylinder at all times at least when said cylinder pin is received in said key notch; a separate key removal member axially insertable into said key slot adjacent said key and having surface means thereon for moving and retaining said cylinder pin radially from said key notch and said abutment means obstruction to thereby permit axial removal of said key from said key slot.

14. In a keyed, pin-tumbler lock as defined in claim 13 in which said abutment means on said key includes a radially outwardly extending key portion axially adjacent an end portion of said cylinder pin.

* * * * *

UNITED STATES PATENT OFFICE
CERTIFICATE OF CORRECTION

PATENT NO. : 4,120,184

DATED : October 17, 1978

INVENTOR(S) : John R. Gerlach

It is certified that error appears in the above-identified patent and that said Letters Patent are hereby corrected as shown below:

--Column 4, line 25, insert view after "sectional" --

--Column 11, line 9, insert pin after "casing"--

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*